US011485142B2

(12) United States Patent
Ueno

(10) Patent No.: US 11,485,142 B2
(45) Date of Patent: Nov. 1, 2022

(54) RECORDING HEAD MAINTENANCE DEVICE AND INK-JET RECORDING APPARATUS PROVIDED WITH THE SAME

(71) Applicant: KYOCERA Document Solutions Inc., Osaka (JP)

(72) Inventor: Daijiro Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 85 days.

(21) Appl. No.: 17/288,878

(22) PCT Filed: Oct. 11, 2019

(86) PCT No.: PCT/JP2019/040263

§ 371 (c)(1),
(2) Date: Apr. 26, 2021

(87) PCT Pub. No.: WO2020/090425

PCT Pub. Date: May 7, 2020

(65) Prior Publication Data

US 2021/0347174 A1 Nov. 11, 2021

(30) Foreign Application Priority Data

Oct. 31, 2018 (JP) ..... JP2018-204954

(51) Int. Cl.
*B41J 2/165* (2006.01)

(52) U.S. Cl.
CPC ..... *B41J 2/16544* (2013.01); *B41J 2/16535* (2013.01); *B41J 2/16538* (2013.01); *B41J 2/16547* (2013.01); *B41J 2/16508* (2013.01); *B41J 2/16585* (2013.01)

(58) Field of Classification Search
CPC ..... B41J 2/16544; B41J 2/16535; B41J 2/16538; B41J 2/16547; B41J 2/16508; B41J 2/16585; B41J 2/16511; B41J 2002/16591
See application file for complete search history.

(56) References Cited

U.S. PATENT DOCUMENTS

| | | | | |
|---|---|---|---|---|
| 5,810,646 | A | 9/1998 | Hepworth | 451/273 |
| 9,969,130 | B1 * | 5/2018 | Lee | B33Y 40/00 |
| 2013/0106952 | A1 | 5/2013 | Tsuji | 347/33 |

FOREIGN PATENT DOCUMENTS

| | | | | |
|---|---|---|---|---|
| CN | 103085476 A | | 5/2013 | |
| JP | 2006-95881 | * | 4/2006 | B41J 2/165 |
| JP | 2014-237324 A | | 12/2014 | |

* cited by examiner

*Primary Examiner* — Geoffrey S Mruk
(74) *Attorney, Agent, or Firm* — Stein IP, LLC

(57) ABSTRACT

A maintenance device includes a wiper, a wiper carriage, a supporting frame, a wiper moving mechanism, and a unit ascending/descending mechanism. The wiper moving mechanism includes a rack supported to the wiper carriage so as to be movable in an up-down direction, a wiper driving motor provided in the supporting frame, a rack driving gear that transmits a driving force of the wiper driving motor to the rack, a sliding member that is rotatably supported to the wiper carriage and comes into contact with the supporting frame, and a gear pitch retention member that maintains constant a positional relationship in the up-down direction between the rack and the rack driving gear during reciprocation of the wiper carriage.

8 Claims, 14 Drawing Sheets

RECORDING HEAD MAINTENANCE DEVICE AND INK-JET RECORDING APPARATUS PROVIDED WITH THE SAME

CROSS-REFERENCE TO RELATED APPLICATIONS

This application is a national stage of International Application No. PCT/JP2019/040263, filed Oct. 11, 2019, which claims the benefit of Japanese Application No. 2018-204954, filed Oct. 31, 2018, in the Japanese Patent Office, the disclosures of which are incorporated herein by reference.

TECHNICAL FIELD

The present invention relates to a recording head maintenance device that is incorporated in an ink-jet recording apparatus, the ink-jet recording apparatus being configured to eject ink on a recording medium so as to perform recording thereon, and causes a wiper for wiping an ink ejection surface of a recording head to move horizontally by use of a rack and a rack driving gear.

BACKGROUND ART

As a recording apparatus such as a facsimile, a copy machine, or a printer, an ink-jet recording apparatus that ejects ink on a recording medium such as paper or an OHP sheet so as to form an image thereon is capable of forming high-definition images and thus is widely used.

In such an ink-jet recording apparatus, in order to prevent drying-up of ink inside ink ejection nozzles having openings provided on an ink ejection surface of a recording head and clogging of the nozzles, the ink is forcibly pushed out of the nozzles (purging). The ink is pushed out in this manner, and thus increased-viscosity ink, air bubbles, impurities, and so on inside the nozzles can be discharged. Furthermore, the ink thus pushed out re-dissolves mist (an ink residue) adhering to the ink ejection surface.

Then, after pushing out the ink, the ink-jet recording apparatus performs a recovery process of recovering the recording head by wiping off, with a blade-shaped wiper, the ink adhering to the ink ejection surface (a nozzle surface). The wiper is formed of an elastic material such as rubber and is elastically deformed to be pressed against the ink ejection surface, and thus it is possible to wipe off the ink while keeping the wiper in tight contact with the ink ejection surface so that no gap is formed between the ink ejection surface and the wiper.

For example, Patent Document 1 discloses an ink-jet recording apparatus that includes a substantially rectangular carriage having a plurality of wipers fixed thereto and a supporting frame supporting the carriage. The ink-jet recording apparatus causes the carriage and the supporting frame to ascend/descend by use of an ascending/descending mechanism and also causes the carriage to move horizontally with respect to the supporting frame so as to perform, in a single operation, wiping of ink ejection surfaces of a plurality of recording heads constituting a line head.

LIST OF CITATIONS

Patent Literature

Patent Document 1: JP-A-2014-237324

SUMMARY OF INVENTION

Technical Problem

A distance between the wiper for cleaning the recording head and the recording head is crucial in order to satisfy cleaning performance and ink scattering suppression performance. Conventionally, in a configuration described in Patent Document 1, in which the carriage is caused to move horizontally by use of a rack provided on the carriage and a rack driving gear provided in the supporting frame, a cylindrical member (a sliding roller) provided on the carriage having the wipers fixed thereto is brought into contact with the supporting frame so that a distance between the carriage and the supporting frame is maintained constant.

According to the above-described configuration, however, due to warping of the supporting frame with which the cylindrical member comes into contact, dimensional tolerance of a clearance of an outer diameter or an inner diameter of the cylindrical member, an error in attaching the rack, or the like, it might be difficult to accurately secure an amount of meshing (a gear pitch) between the rack and the rack driving gear. A decrease in the amount of meshing makes it likely that efficiency in transmitting a driving force from the rack driving gear to the rack decreases or that tooth skipping occurs. On the other hand, an increase in the amount of meshing increases a driving load of the rack. As a result, there has been a fear that a failure to wipe off ink might occur due to fluctuations in wiper speed.

In view of the above-described problem, it is an object of the present invention to provide a recording head maintenance device and an ink-jet recording apparatus provided with the same. The maintenance device is capable of, by use of a simple configuration, maintaining constant a distance between a rack provided on a carriage having a wiper fixed thereto and a rack driving gear that transmits a driving force to the rack.

Solution to Problem

In order to achieve the above-described object, a first configuration of the present invention relates to a recording head maintenance device including a wiper, a wiper carriage, a supporting frame, a wiper moving mechanism, and a unit ascending/descending mechanism. The maintenance device causes the wiper carriage to reciprocate and ascend/descend so as to perform wiping of an ink ejection surface of a recording head. The wiper is used to wipe the ink ejection surface of the recording head that ejects ink on a recording medium. The wiper carriage has the wiper fixed thereto. The supporting frame supports the wiper carriage so that the wiper carriage is movable in a horizontal direction. The wiper moving mechanism causes the wiper carriage to reciprocate along the supporting frame. The unit ascending/descending mechanism causes the supporting frame to ascend/descend together with the wiper carriage in such a direction as to approach or separate from the ink ejection surface. The wiper moving mechanism includes a rack supported to the wiper carriage so as to be movable in an up-down direction, a wiper driving motor provided in the supporting frame, a rack driving gear that transmits a driving force of the wiper driving motor to the rack, a sliding member that is rotatably supported to the wiper carriage and comes into contact with the supporting frame so as to retain constant a spacing between the wiper carriage and the supporting frame, and a gear pitch retention member that maintains constant a positional relationship in the up-down direction between the rack and the rack driving gear during reciprocation of the wiper carriage.

Advantageous Effects of Invention

According to the first configuration of the present invention, the positional relationship in the up-down direction between the rack and the rack driving gear during reciprocation of the wiper carriage is maintained constant by the gear pitch retention member. Thus, irrespective of warping of the supporting frame, dimensional tolerance of the sliding member, an error in attaching the rack, or the like, an amount of meshing (a gear pitch) between the rack and the rack driving gear can be always maintained constant. Accordingly, it is possible to prevent a decrease in efficiency in transmitting a driving force from the rack driving gear to the rack and fluctuations in wiper speed caused thereby, thus suppressing a failure to wipe the ink ejection surface.

DESCRIPTION OF EMBODIMENTS

Figure 1:
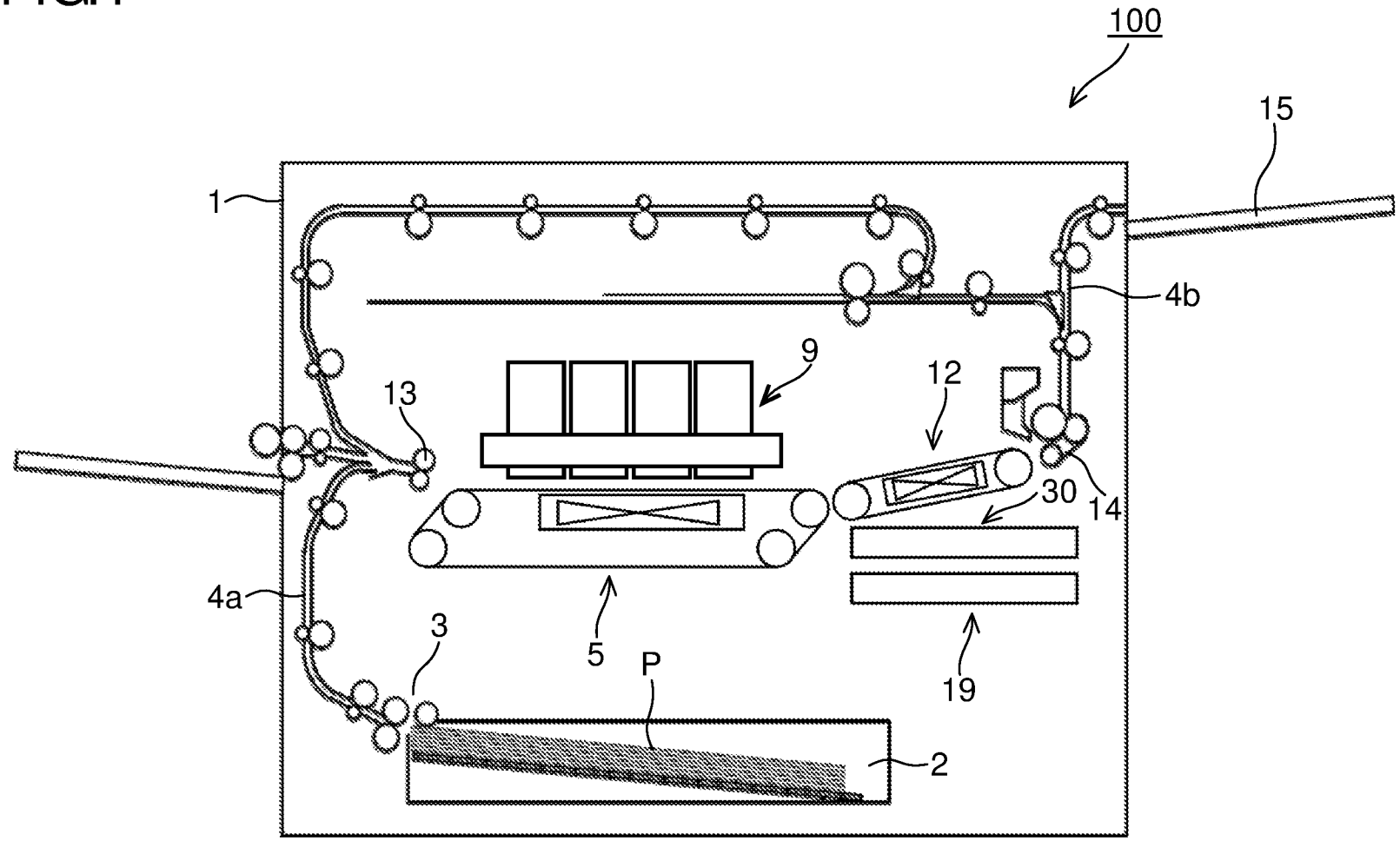
FIG. 1 is a view showing a structure of an ink-jet type printer 100 in which a maintenance unit 19 of the present invention is incorporated.

With reference to FIG. 1 to FIG. 24, the following describes an ink-jet printer 100 (which is an ink-jet recording apparatus and is hereinafter referred to as a printer 100) in which a maintenance unit 19 of the present invention is incorporated. As shown in FIG. 1, in the printer 100, a paper feed cassette 2 that is a sheet housing portion is disposed on a lower side inside a printer main body 1. A sheet P that is one example of a recording medium is housed inside the paper feed cassette 2. A paper feeder 3 is disposed on a downstream side of the paper feed cassette 2 in a sheet conveyance direction, i.e., on an upper left side of the paper feed cassette 2 in FIG. 1. By the paper feeder 3, the sheet P is fed out one by one separately toward the upper left side of the paper feed cassette 2 in FIG. 1.

Furthermore, the printer 100 is provided inside with a first sheet conveyance path 4*a*. The first sheet conveyance path 4*a* is located on the upper left side of the paper feed cassette 2, which is a direction of paper feed from the paper feed cassette 2. By the first sheet conveyance path 4*a*, the sheet P fed out from the paper feed cassette 2 is conveyed vertically upward along a side surface of the printer main body 1.

A pair of registration rollers 13 is provided at a downstream end of the first sheet conveyance path 4*a* with respect to the sheet conveyance direction. Moreover, a first belt conveyance portion 5 and a recording portion 9 are disposed in immediate proximity to a downstream side of the registration roller pair 13 in the sheet conveyance direction. The sheet P fed out from the paper feed cassette 2 passes through the first sheet conveyance path 4*a* to reach the registration roller pair 13. The registration roller pair 13 stops the sheet P once from being conveyed and, while correcting oblique feeding, conveys the sheet P again toward the first belt conveyance portion 5 so as to be timed with an ink ejection operation executed by the recording portion 9.

A second belt conveyance portion 12 is disposed on a downstream side (a right side in FIG. 1) of the first belt conveyance portion 5 with respect to the sheet conveyance direction. The sheet P on which an ink image has been recorded at the recording portion 9 is fed to the second belt conveyance portion 12, and ink ejected on a surface of the sheet P is dried up as the sheet P passes through the second belt conveyance portion 12.

A de-curler portion 14 is provided on a downstream side of the second belt conveyance portion 12 with respect to the sheet conveyance direction and near a right side surface of the printer main body 1. The sheet P on which the ink thereon has been dried up at the second belt conveyance portion 12 is fed to the de-curler portion 14 where a curl generated in the sheet P is corrected by use of a plurality of rollers arranged in a sheet width direction.

A second sheet conveyance path 4*b* is provided on a downstream side (an upper side in FIG. 1) of the de-curler portion 14 with respect to the sheet conveyance direction. In a case of not performing double-sided recording on the sheet P, the sheet P that has passed through the de-curler portion 14 is discharged from the second sheet conveyance path 4*b* via a discharge roller pair onto a sheet discharge tray 15 provided outside the right side surface of the printer 100.

Furthermore, the maintenance unit 19 and a cap unit 30 are disposed below the second belt conveyance portion 12. When executing after-mentioned purging, the maintenance unit 19 moves horizontally to under the recording portion 9, wipes off ink pushed out of ejection nozzles 18 (see FIG. 2) of each of after-mentioned recording heads 17*a* to 17*c*, and collects the ink thus wiped off. When performing capping of an ink ejection surface F (see FIG. 4) of each of the recording heads 17*a* to 17*c*, the cap unit 30 moves horizontally to under the recording portion 9 and further moves upward to be mounted to lower surfaces of the recording heads 17*a* to 17*c*.

Figure 2:
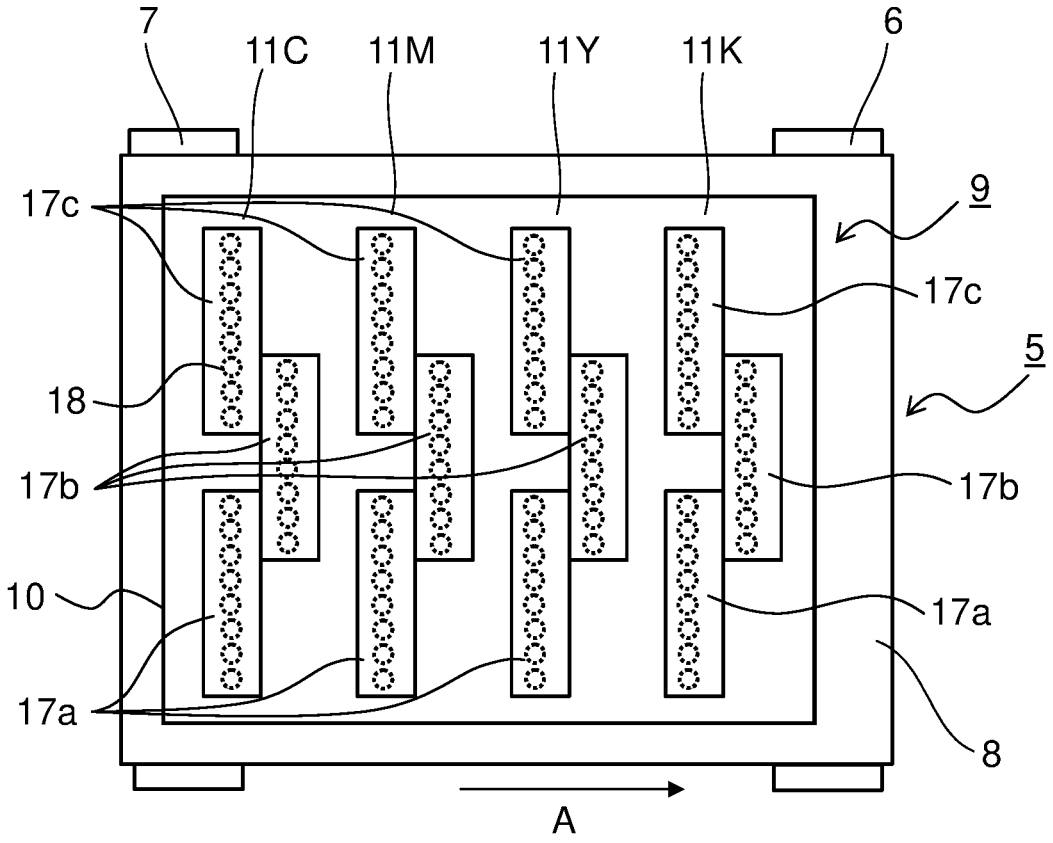
FIG. 2 is a view of a first belt conveyance portion 5 and a recording portion 9 of the printer 100 as seen from above.
Figure 3:
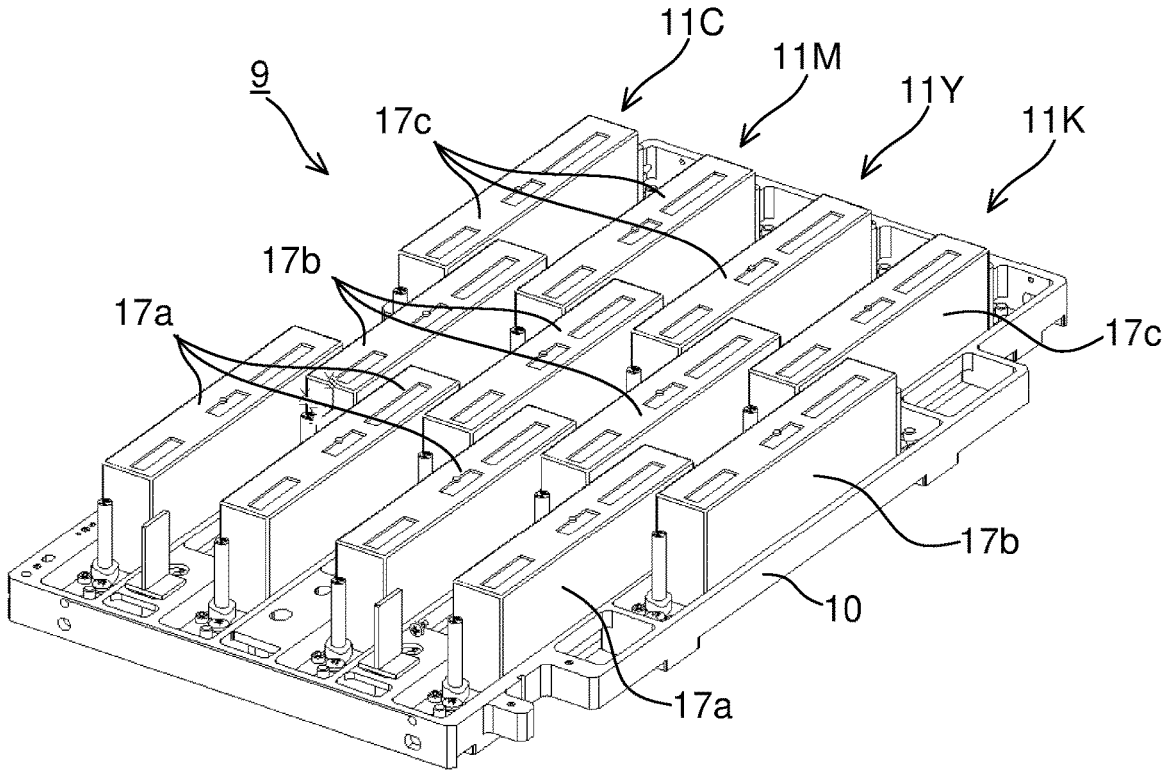
FIG. 3 is a view showing a structure of the recording portion 9 of the printer 100.
Figure 4:
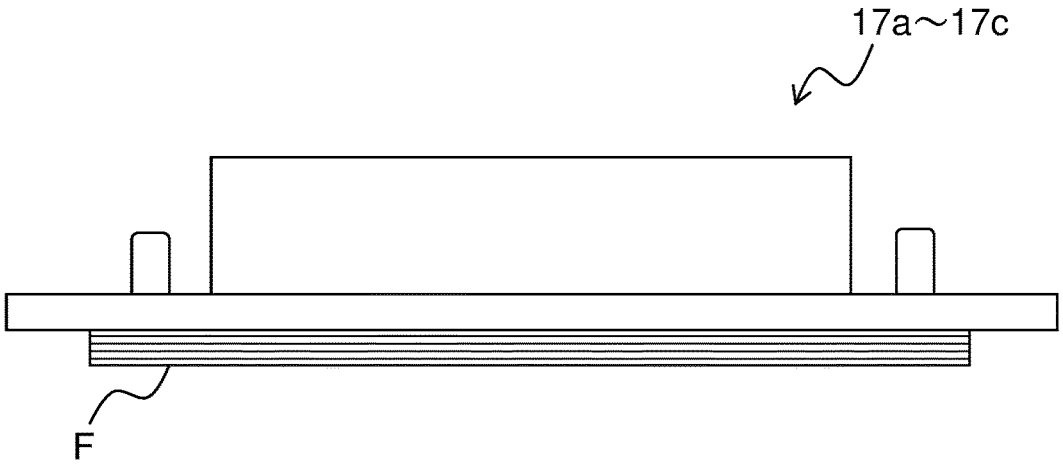
FIG. 4 is a view showing a structure of each of recording heads 17*a* to 17*c* constituting line heads 11C to 11K of the recording portion 9 of the printer 100.

As shown in FIG. 2 and FIG. 3, the recording portion 9 includes a head housing 10 and line heads 11C, 11M, 11Y, and 11K held in the head housing 10. The line heads 11C, 11M, 11Y, and 11K are supported at such a height as to form a prescribed spacing (of, for example, 1 mm) with respect to a conveyance surface of a first conveyance belt 8 stretched over a plurality of rollers including a driving roller 6 and a driven roller 7. Each of the line heads 11C, 11M, 11Y, and 11K includes a plurality of (here, three) recording heads 17*a* to 17*c* arrayed in a staggered manner along the sheet width direction (an up-down direction in FIG. 2) orthogonal to the sheet conveyance direction (an arrow A direction). Each of the line heads 11C, 11M, 11Y, and 11K has a recording region having a width equal to or larger than a width of the sheet P being conveyed and ejects aqueous ink (hereinafter, referred to simply as ink) with respect to the sheet P being conveyed by the first conveyance belt 8 through any of the ejection nozzles 18 which correspond(s) to a printing position(s).

Figure 5:
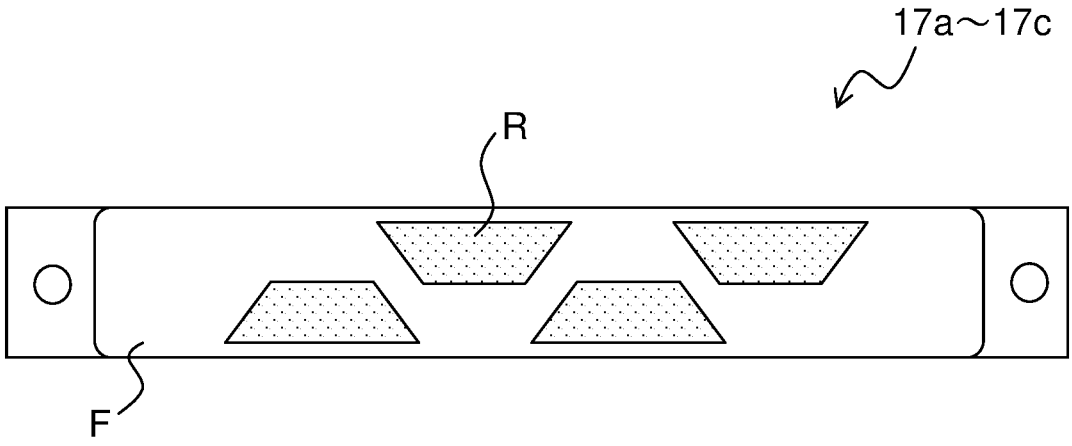
FIG. 5 is a view of each of the recording heads 17*a* to 17*c* of the printer 100 as seen from an ink ejection surface F side.

As shown in FIG. 5, on the ink ejection surface F of each of the recording heads 17*a* to 17*c*, there is provided a nozzle region R in which a multitude of ejection nozzles 18 are arrayed. Furthermore, a water-repellent film (not shown) is formed on the ink ejection surface F. The recording heads 17*a* to 17*c* are the same in shape and configuration and are, therefore, shown to be represented by one recording head in FIG. 4 and FIG. 5.

The recording heads 17*a* to 17*c* constituting each of the line heads 11C, 11M, 11Y, and 11K are supplied with ink of four colors (cyan, magenta, yellow, and black) stored in ink tanks (not shown), respectively, so as to correspond to respective colors of the line heads 11C, 11M, 11Y, and 11K.

Based on image data received from an external computer, each of the recording heads 17*a* to 17*c* ejects ink through the ejection nozzles 18 toward the sheet P being conveyed while being absorbed and held to the conveyance surface of the first conveyance belt 8. Thus, a color image composed of the four colors of cyan, magenta, yellow, and black superimposed on each other is formed on the sheet P on the first conveyance belt 8.

Furthermore, in order to prevent drying of the recording heads 17*a* to 17*c* and an ink ejection failure due to clogging, purging is executed in preparation for a next printing operation. In a case where purging is executed at a start of printing after a long period of non-operation, ink having an increased viscosity inside the ejection nozzles 18 is pushed out of all the ejection nozzles 18 of the recording heads 17*a* to 17*c*, and in a case where purging is executed during an interval between printing operations, such ink is pushed out of any of the ejection nozzles 18 of the recording heads 17*a* to 17*c*, which has/have an ink ejection amount of a predetermined value or less.

Figure 6:
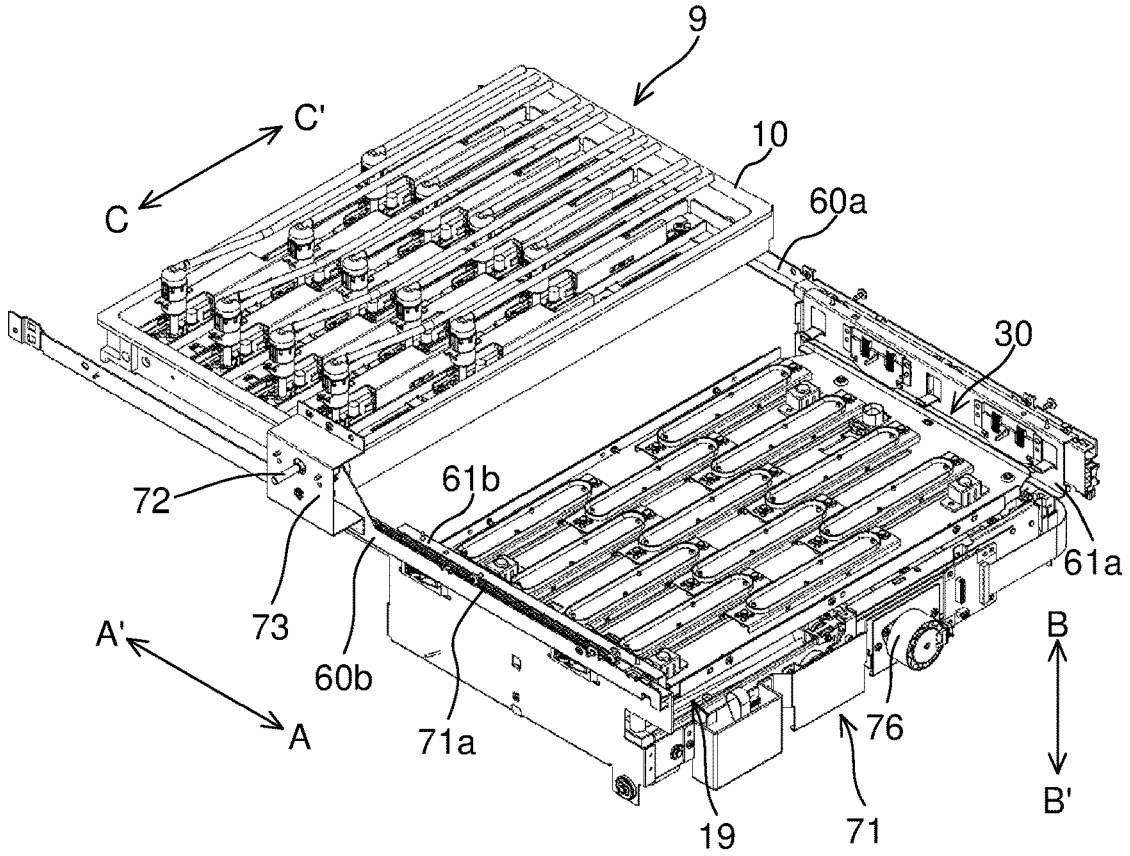
FIG. 6 is a view showing structures of the recording portion 9, a cap unit 30, a maintenance unit 19, and so on of the printer 100.

As shown in FIG. 6, two guide rails 60*a* and 60*b* are fixed to a lower part of the recording portion 9 along both ends thereof parallel to the sheet conveyance direction (the arrow A direction). A pair of guide plates 61*a* and 61*b* are fixed to the guide rails 60*a* and 60*b*, respectively, and side end edges of the cap unit 30 are supported to lower ends of the guide plates 61*a* and 61*b*, respectively. Furthermore, a carriage 71 is slidably supported to the guide rails 60*a* and 60*b*, and the maintenance unit 19 is placed on the carriage 71.

The cap unit 30 is capable of reciprocation between a first position (a position shown in FIG. 18) immediately under the recording portion 9 and a second position (a position shown in FIG. 6) retracted in a horizontal direction (the arrow A direction) from the first position. The cap unit 30 moves upward at the first position so as to perform capping of the recording heads 17*a* to 17*c*.

Figure 7:
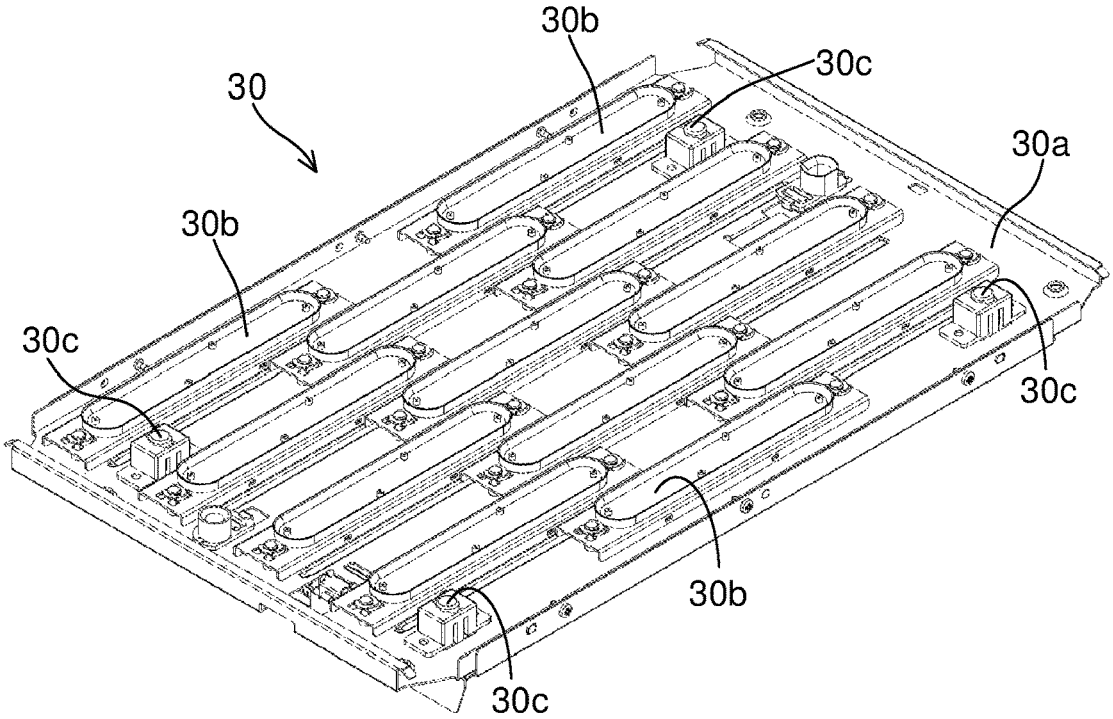
FIG. 7 is a view showing the structure of the cap unit 30 of the printer 100.

Specifically, as shown in FIG. 7, the cap unit 30 includes a cap tray 30*a* made of sheet metal, 12 concave cap portions 30*b* disposed on an upper surface of the cap tray 30*a*, and four height direction positioning protrusions 30*c*.

The cap portions 30*b* are disposed at positions corresponding to the recording heads 17*a* to 17*c*, respectively. Thus, when the cap unit 30 moves upward at the first position, the cap portions 30*b* cap the respective ink ejection surfaces F of the recording heads 17*a* to 17*c*. When the cap unit 30 is caused to ascend toward the recording portion 9 so as to perform capping of the recording heads 17*a* to 17*c*, the height direction positioning projections 30*c* come into contact with the housing 10 of the recording portion 9. Thus, a contact state between the cap portions 30*b* and the ink ejection surfaces F is retained constant.

The maintenance unit 19 is capable of reciprocation between a first position (a position shown in FIG. 15) immediately under the recording portion 9 and a second position (a position shown in FIG. 6) retracted in the horizontal direction (the arrow A direction) from the first position. The maintenance unit 19 moves upward at the first position so as to perform an after-mentioned wiping operation.

Specifically, a driving motor 72 for causing the carriage 71 to move in an arrow A-A' direction, a gear train (not shown) that engages with the driving motor 72 and rack teeth 71*a* of the carriage 71, and a cover member 73 covering these components are attached to an outside of the guide rail 60*b*. The driving motor 72 rotates forward to cause the gear train to rotate, so that the carriage 71 and the maintenance unit 19 move from the second position to the first position. The driving motor 72, the gear train, and so on constitute a unit moving mechanism that causes the maintenance unit 19 to move in the horizontal direction.

Figure 8:
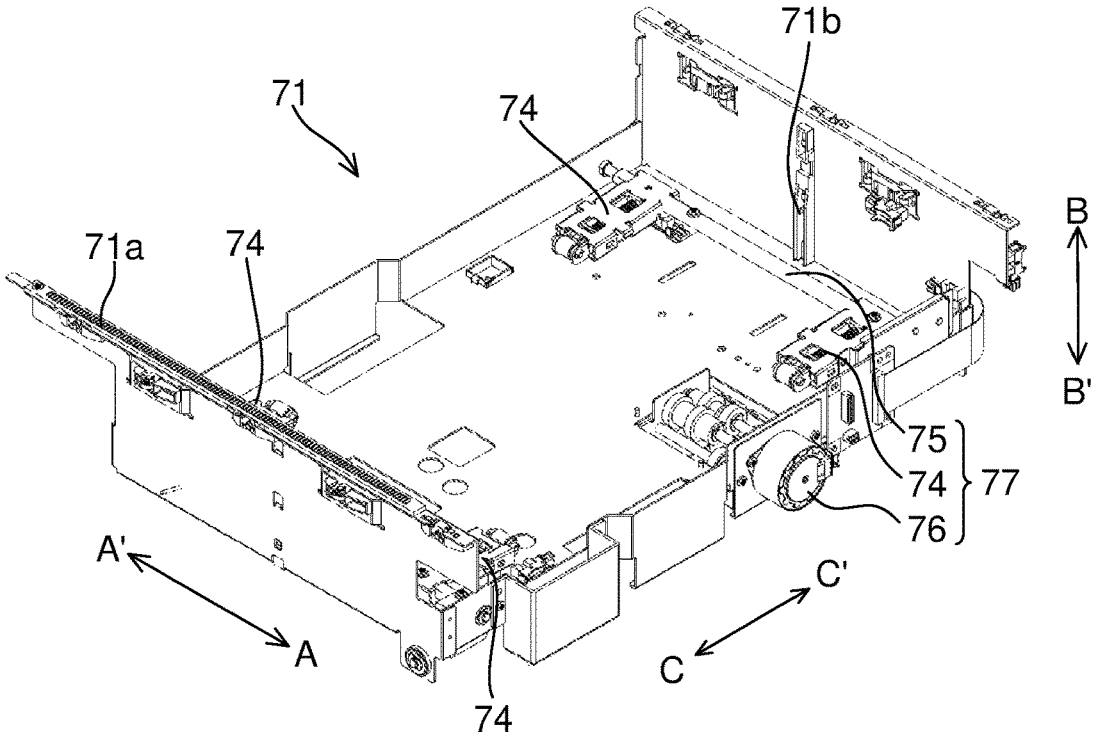
FIG. 8 is a perspective view showing a structure of a carriage 71 of the printer 100 in a state where a supporting arm 74 has been folded.
Figure 9:
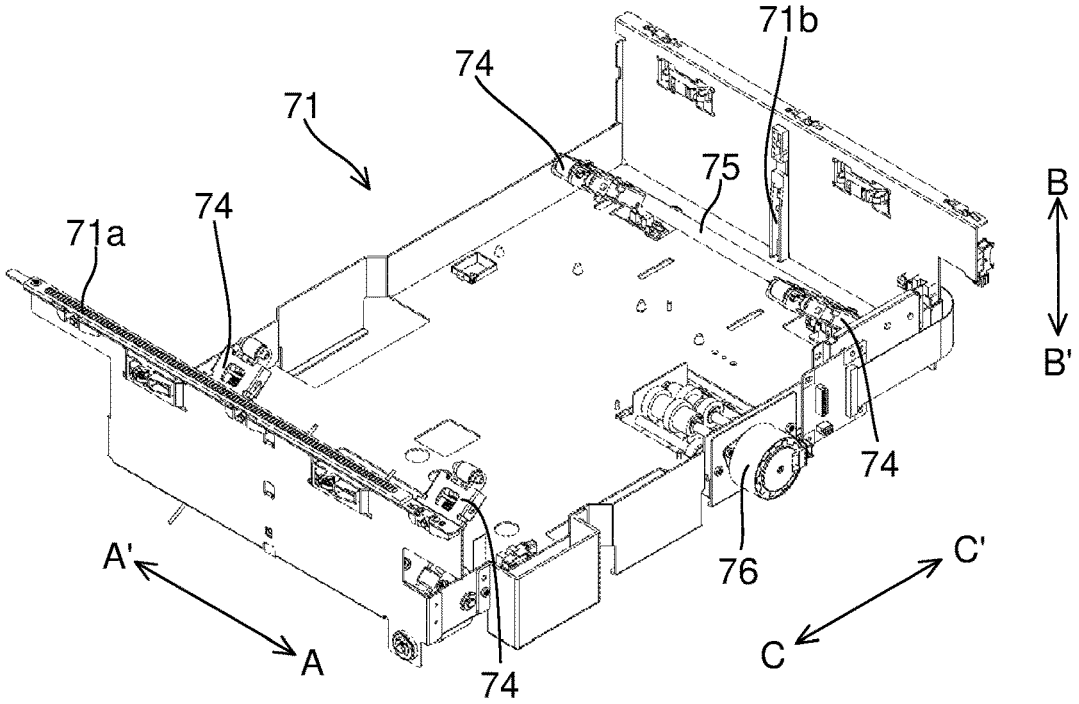
FIG. 9 is a perspective view showing a structure of the carriage 71 of the printer 100 in a state where the supporting arm 74 has been raised.

As shown in FIG. 8 and FIG. 9, supporting arms 74 that support the maintenance unit 19 from a lower surface side and are capable of swinging (being raised or folded) are provided at four corners of the carriage 71, respectively. Among the supporting arms 74, each adjacent pair of supporting arms 74 in the arrow A-A' direction are connected to each other via a rotation shaft 75. Furthermore, a wipe ascending/descending motor 76 for causing the supporting arms 74 to swing and a gear train or the like (not shown) that engages with the wipe ascending/descending motor 76 and a gear of the rotation shaft 75 are attached to an outside of the carriage 71. The wipe ascending/descending motor 76 rotates forward to cause the gear train or the like to rotate and thus to cause the rotation shaft 75 to swivel, so that the supporting arms 74 swing (are raised). This causes the maintenance unit 19 to ascend. The wipe ascending/descending motor 76, the gear train, the rotation shaft 75, the supporting arms 74, and so on constitute a unit ascending/descending mechanism 77 that causes the maintenance unit 19 to move in the up-down direction (an arrow B-B' direction). Furthermore, a guide groove 71*b* is formed to extend in the up-down direction on an inner surface of the carriage 71, and the maintenance unit 19 ascends/descends along the guide groove 71*b*.

Figure 10:
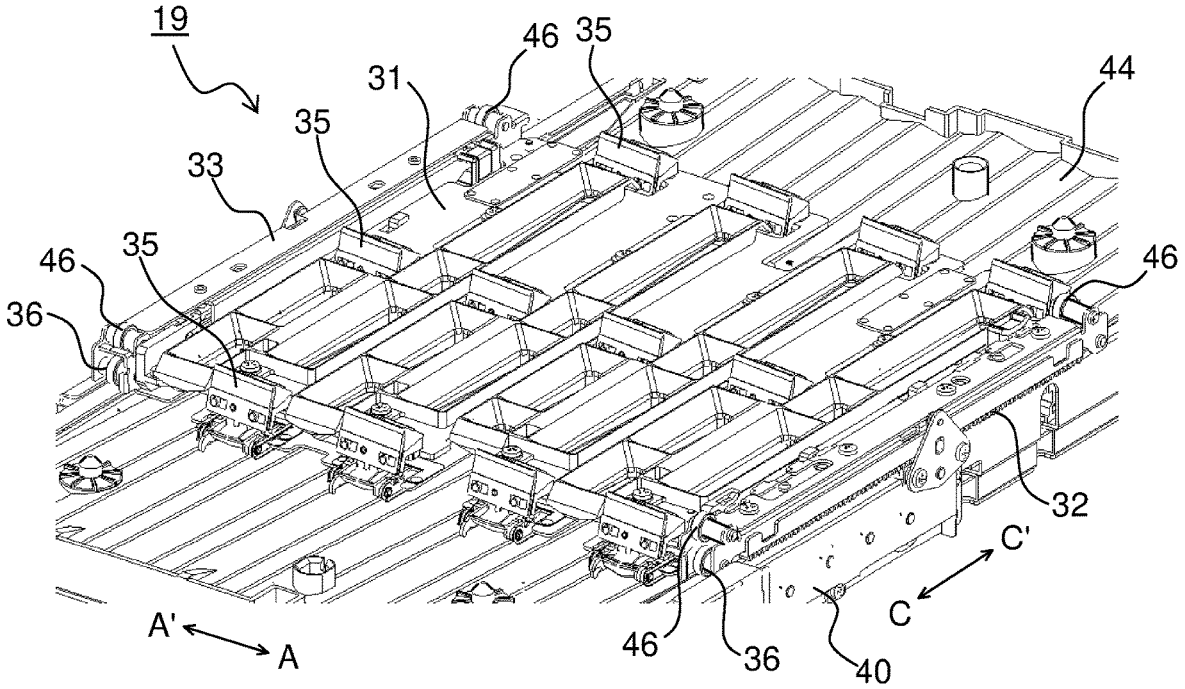
FIG. 10 is an enlarged view, as seen from above, of the maintenance unit 19 according to one embodiment of the present invention, which is incorporated in the printer 100.
Figure 11:
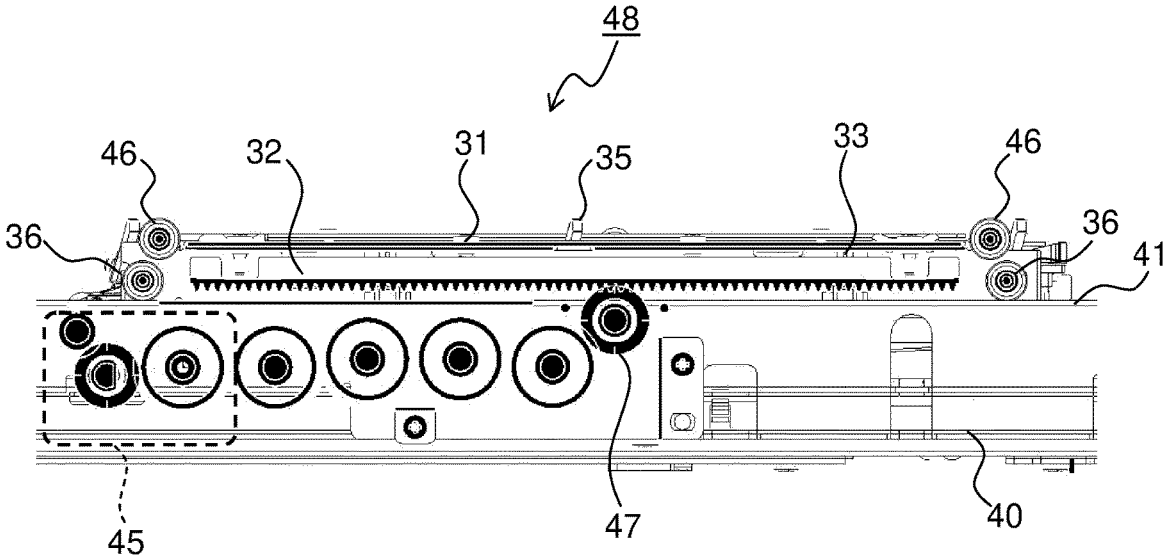
FIG. 11 is a sectional view showing a structure of a wiper moving mechanism 48 of the maintenance unit 19 of this embodiment.
Figure 12:
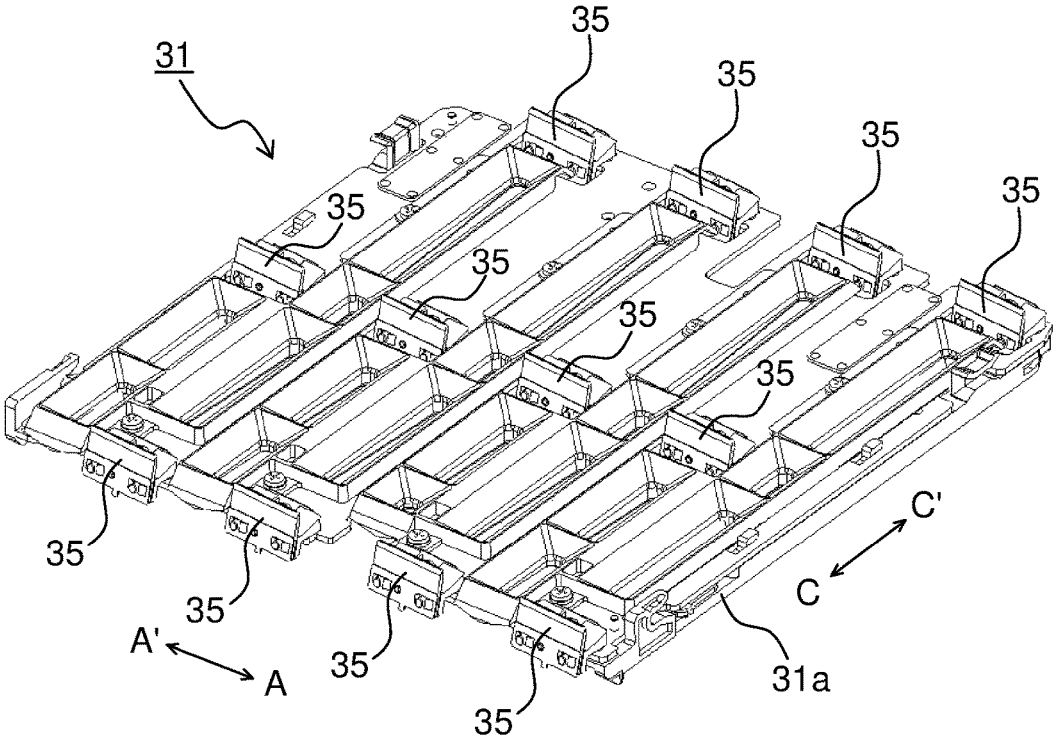
FIG. 12 is a perspective view of a blade unit 31 that is a component of the maintenance unit 19 of this embodiment.
Figure 13:
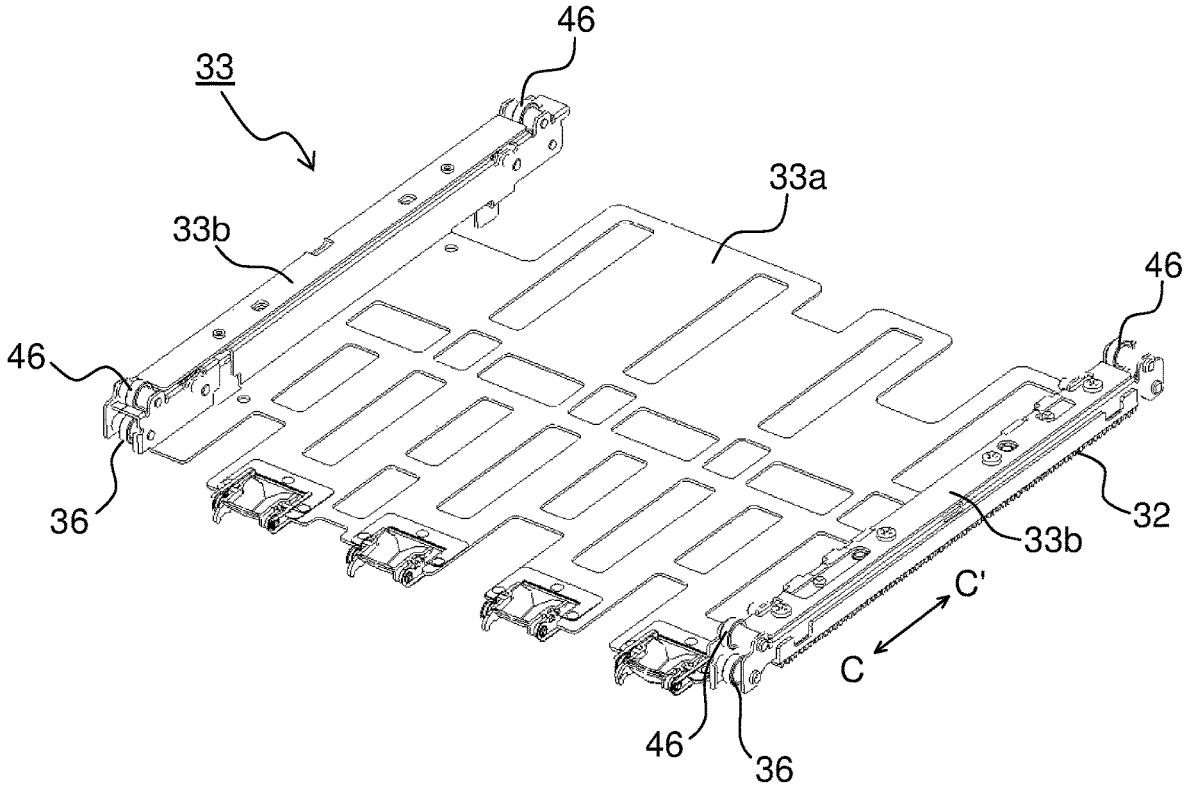
FIG. 13 is a perspective view of a wiper carriage 33 that is a component of the maintenance unit 19 of this embodiment.

FIG. 10 is an enlarged view of the maintenance unit 19 incorporated in the printer 100 as seen from above. FIG. 11 is a sectional view showing a structure of a wiper moving mechanism 48 of the maintenance unit 19. FIG. 12 and FIG. 13 are perspective views, respectively, of a blade unit 31 and a wiper carriage 33 that are components of the maintenance unit 19. The maintenance unit 19 is constituted of the blade unit 31 having a plurality of wipers (wiper blades) 35 fixed thereto, the substantially rectangular wiper carriage 33 to which the blade unit 31 is mounted, and a supporting frame 40 supporting the wiper carriage 33.

As shown in FIG. 10 and FIG. 11, a rail groove 41 is formed at each of opposed end edges of an upper surface of the supporting frame 40. A sliding pulley 36 provided at each of four locations on the wiper carriage 33 comes into contact with the rail groove 41, and thus the wiper carriage 33 is supported so as to be slidable in an arrow C-C' direction with respect to the supporting frame 40.

A wiper driving motor 45 for causing the wiper carriage 33 to move in a horizontal direction (the arrow C-C' direction) and a rack driving gear 47 that engages with a rack 32 of the wiper carriage 33 are attached to the supporting frame 40. The wiper driving motor 45 rotates forward/reversely to cause the rack driving gear 47 to rotate forward/reversely via a gear train, so that the wiper carriage 33 reciprocates in the horizontal direction (the arrow C-C' direction). The rack 32, the sliding pulley 36, the wiper driving motor 45, the rack driving gear 47, and an after-mentioned gear pitch retention member 50 (see FIG. 19) constitute the wiper moving mechanism 48 that causes the wipers 35 to move along the ink ejection surfaces F of the recording heads 17*a* to 17*c*.

An ink collection tray 44 for collecting waste ink wiped off from the ink ejection surfaces F by the wipers 35 is disposed on the upper surface of the supporting frame 40. An ink discharge hole (not shown) is formed at substantially a center of the ink collection tray 44, and tray surfaces on both sides with respect to the ink discharge hole have a downward gradient toward the ink discharge hole. The waste ink that had been wiped off from the ink ejection surfaces F by the wipers 35 and has dropped on the tray surfaces flows toward the ink discharge hole. After that, the waste ink passes through an ink collection passage (not shown) connected to the ink discharge hole and is collected in a waste ink collection tank (not shown).

The wipers 35 are members made of rubber such as, for example, EPDM and used to wipe off ink pushed out of the ejection nozzles 18 of the recording heads 17*a* to 17*c*. Each of the wipers 35 is brought into pressure contact from a substantially vertical direction with a wiping start position outside the nozzle region R (see FIG. 5) in which the ejection nozzles 18 are exposed, and as the wiper carriage 33 moves, wipes the ink ejection surface F including the nozzle region R in a prescribed direction (an arrow C direction).

As shown in FIG. 12, a total of 12 wipers 35 are disposed, i.e., a group of four wipers 35 are disposed at substantially equal intervals in a width direction (the arrow A-A' direction) of a unit main body 31*a* of the blade unit 31, and three rows of such groups are disposed in a movement direction (the arrow C-C' direction) of the wiper carriage 33. The wipers 35 are disposed at positions corresponding to the recording heads 17*a* to 17*c* (see FIG. 3) constituting the line heads 11C to 11K. The blade unit 31 is mountable/demountable with respect to the wiper carriage 33, and in a case where any of the wipers 35 is/are worn or damaged, the blade unit 31, together with the unit main body 31*a*, is replaced in a collective manner.

As shown in FIG. 13, the wiper carriage 33 includes a flat plate-shaped carriage main body 33*a* and a rail portion 33*b* provided at each of both side ends of the carriage main body 33*a*. The blade unit 31 is mounted to the carriage main body 33*a*. The rack 32, the sliding pulley 36, and a positioning pulley 46 are provided in the rail portion 33*b*. The rack 32 is provided along one end edge of the carriage main body 33*a* and meshes with the rack driving gear 47 of the supporting frame 40. The sliding pulley 36 comes into contact with the rail groove 41 formed in the supporting frame 40.

The positioning pulley 46 is provided at each of four locations on an upper surface of the carriage main body 33*a*. When the supporting frame 40 is caused to ascend toward the recording portion 9 so that an operation of wiping the ink ejection surfaces F of the recording heads 17*a* to 17*c* is performed, the positioning pulley 46 comes into contact with the head housing 10 of the recording portion 9, and thus a contact state between the wipers 35 and the ink ejection surfaces F is retained constant.

Figure 14:
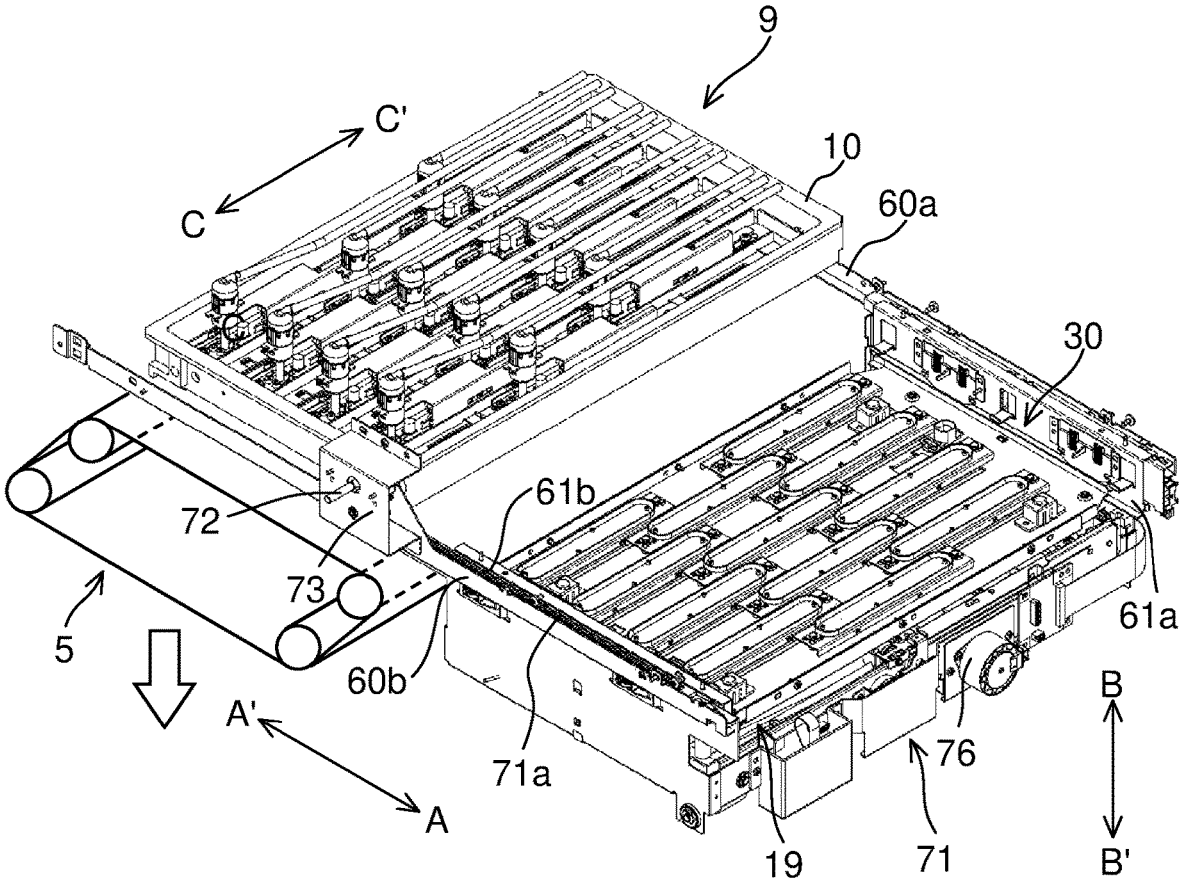
FIG. 14 is a view showing a state where the first belt conveyance portion 5 of the printer 100 has descended.
Figure 15:
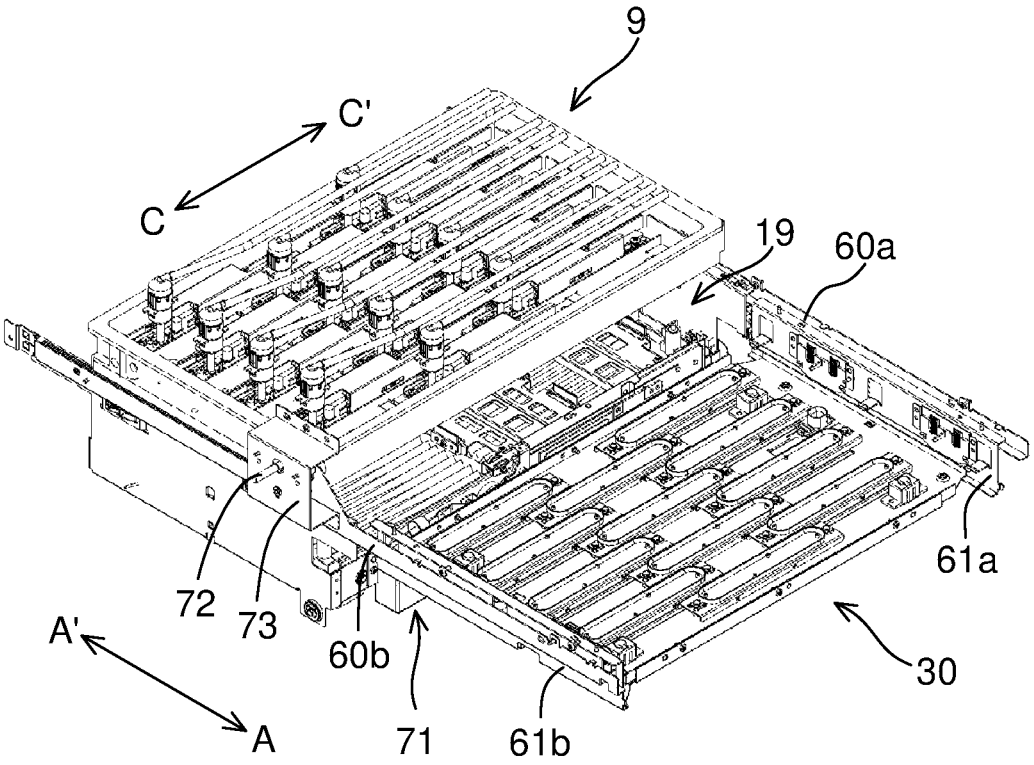
FIG. 15 is a view showing a state where the maintenance unit 19 of the printer 100 has moved to a first position.

Next, a description is given of an operation of recovering the recording heads 17*a* to 17*c* in the printer 100. In a case where the operation of recovering the recording heads 17*a* to 17*c* is performed by the maintenance unit 19, as shown in FIG. 14, the first belt conveyance portion 5, which is disposed so as to be opposed to a lower surface of the recoding portion 9, is caused to descend. Then, as shown in FIG. 15, in a state where the cap unit 30 remains at the second position, the maintenance unit 19 is caused to move from the second position to the first position by the unit moving mechanism.

Then, prior to the wiping operation, ink 22 is supplied to the recording heads 17*a* to 17*c*. The ink 22 thus supplied is forcibly pushed (purged) out of the ejection nozzles 18. By this purging operation, any increased-viscosity ink, foreign substances, and air bubbles inside the ejection nozzles 18 are discharged, and thus the recording heads 17*a* to 17*c* can be recovered.

Figure 16:
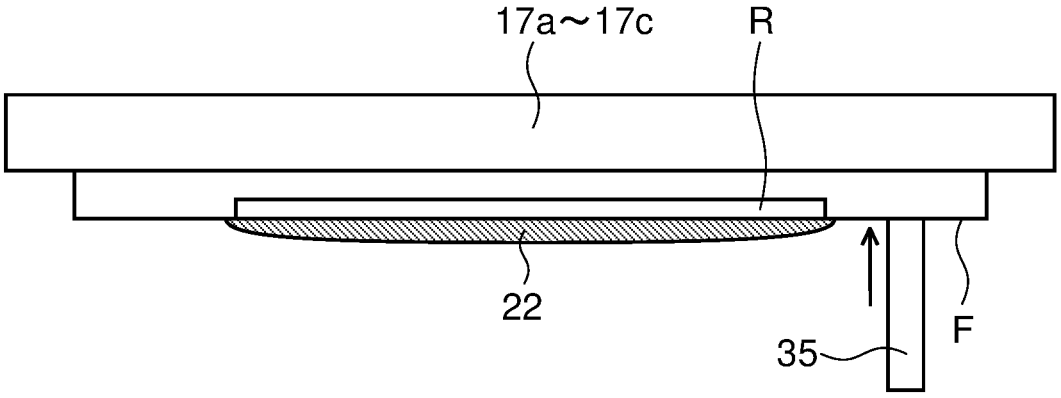
FIG. 16 is a view showing a state where a wiper 35 has been brought into pressure contact with a wiping start position on an ink ejection surface F of each of the recording heads 17*a* to 17*c*.

Next, the wiping operation of wiping off the ink 22 discharged onto the ink ejection surfaces F is performed. Specifically, as shown in FIG. 16, the maintenance unit 19 is caused to ascend by the unit ascending/descending mechanism 77, and thus each of the wipers 35 is brought into pressure contact with the wiping start position on the ink ejection surface F of each of the recording heads 17*a* to 17*c*.

Figure 17:
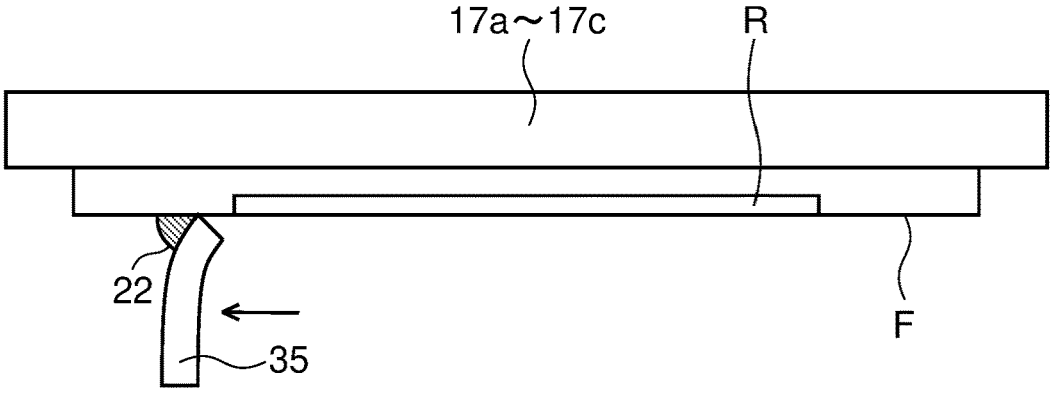
FIG. 17 is a view showing a state where purged ink pushed out on the ink ejection surface F of each of the recording heads 17*a* to 17*c* is being wiped off by the wiper 35.

Then, the wiper carriage 33 is caused to move horizontally in the arrow C direction by the wiper driving motor 45 (see FIG. 11), and thus, as shown in FIG. 17, each of the wipers 35 wipes off the ink 22 pushed out on the ink ejection surface F of each of the recording heads 17*a* to 17*c*.

After each of the wipers 35 has moved to a downstream-side end of the ink ejection surface F of each of the recording heads 17*a* to 17*c*, the wiper carriage 33 is caused to descend by the unit ascending/descending mechanism 77. Thus, the wipers 35 are retracted downward from the ink ejection surfaces F of the recording heads 17*a* to 17*c*.

After that, the maintenance unit 19 is caused to move in the arrow A direction from the first position by the unit moving mechanism. Thus, as shown in FIG. 14, the maintenance unit 19 is disposed at a prescribed position (the second position) immediately under the cap unit 30.

Next, a description is given of an operation of mounting the cap unit 30 to the recording heads 17*a* to 17*c* in the printer 100 of this embodiment. In a case where capping of the recording heads 17*a* to 17*c* is performed by the cap unit 30, as shown in FIG. 14, the first belt conveyance portion 5, which is disposed so as to be opposed to the lower surface of the recording portion 9, is caused to descend.

Figure 18:
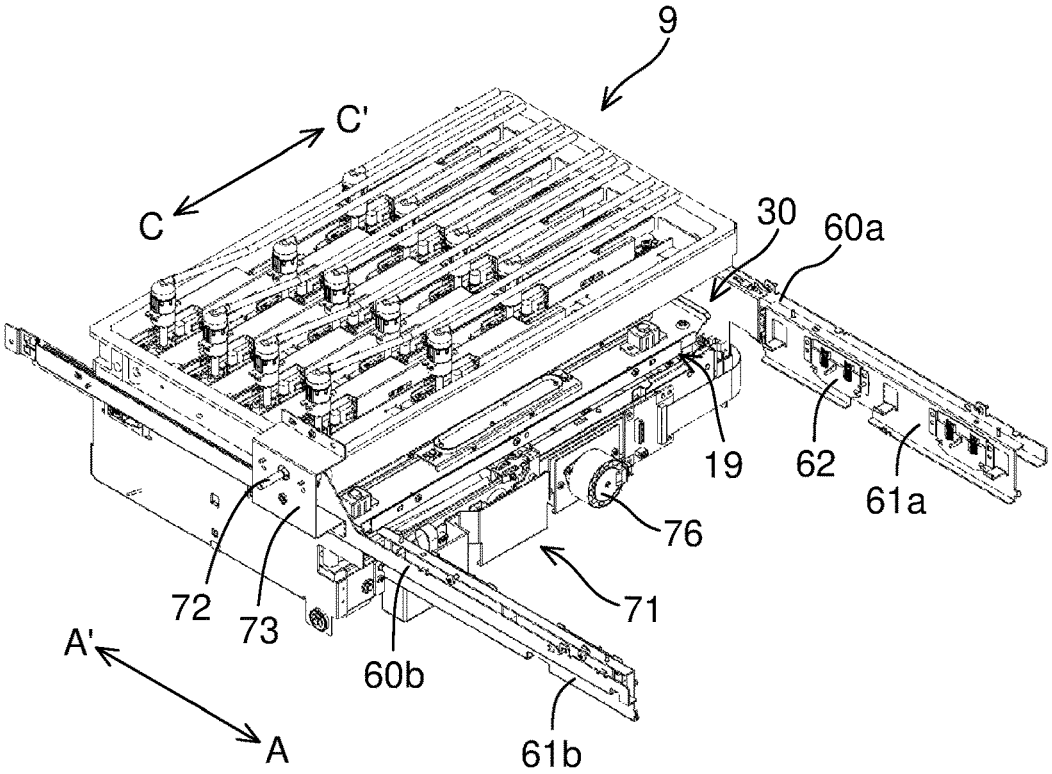
FIG. 18 is a view showing a state where the cap unit 30 and the maintenance unit 19 of the printer 100 have moved to the first position.

Then, as shown in FIG. 18, in a state where the cap unit 30 is disposed over the maintenance unit 19, the maintenance unit 19 and the cap unit 30 are caused to move from the second position to the first position by the unit moving mechanism. After that, the maintenance unit 19 and the cap unit 30 are caused to ascend by the unit ascending/descending mechanism 77, and thus the cap unit 30 (the cap portions 30*b*) is mounted to the recording heads 17*a* to 17*c*.

Figure 19:
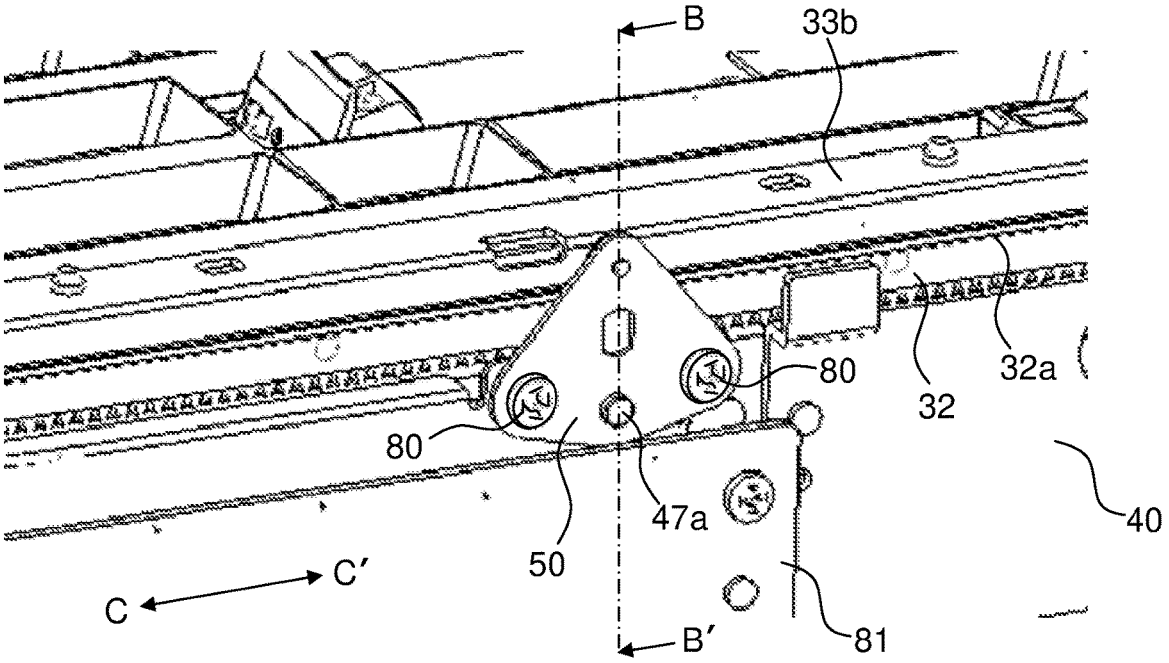
FIG. 19 is an enlarged view of a contact area between a supporting frame 40 and the wiper carriage 33 of the maintenance unit 19 of this embodiment as seen sideways.

FIG. 19 is an enlarged view of a contact area between the supporting frame 40 and the wiper carriage 33 of the maintenance unit 19 as seen sideways. The rack 32 is a member separate from the wiper carriage 33 and is supported to the rail portion 33*b* of the wiper carriage 33 with prescribed play (backlash) in the up-down direction provided therebetween. That is, the rack 32 is supported so as to be movable only in the up-down direction with respect to the wiper carriage 33. A horizontally protruding flange portion 32*a* is integrally formed on a side surface of the rack 32 along the movement direction (the arrow C-C' direction) of the wiper carriage 33.

The supporting frame 40 is provided with the rack driving gear 47 (see FIG. 20) that transmits a driving force of the wiper driving motor 45 (see FIG. 11) to the rack 32. When the wiper carriage 33 is installed on the upper surface of the supporting frame 40, the sliding pulley 36 (see FIG. 13) comes into contact with the rail groove 41 (see FIG. 11) of the supporting frame 40, so that the rack 32 and the rack driving gear 47 mesh with each other. The wiper driving motor 45 is driven in this state so that the rack driving gear 47 rotates forward/reversely, and thus the wiper carriage 33, together with the rack 32, reciprocates in the horizontal direction (the arrow C-C' direction). The gear pitch retention member 50 is fixed with a screw 80 to the supporting frame 40.

Figure 20:
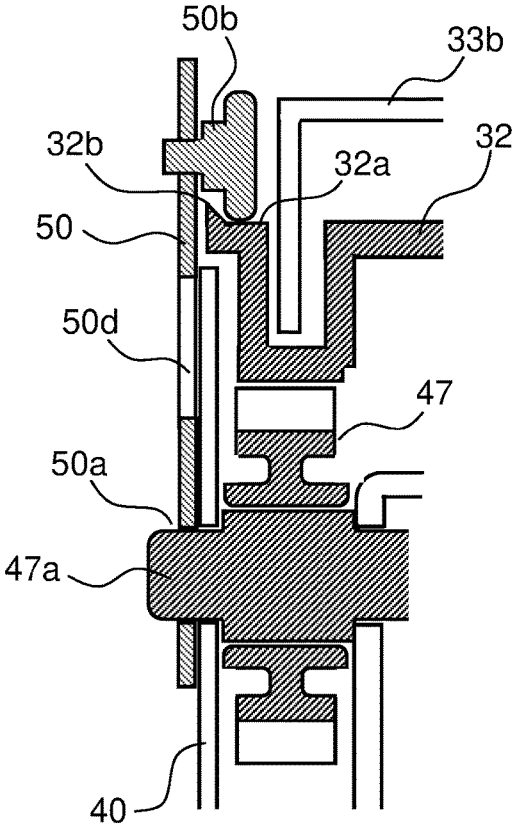
FIG. 20 is a longitudinal sectional view including an engagement part between a rack 32 and a rack driving gear 47 shown in FIG. 19.
Figure 21:
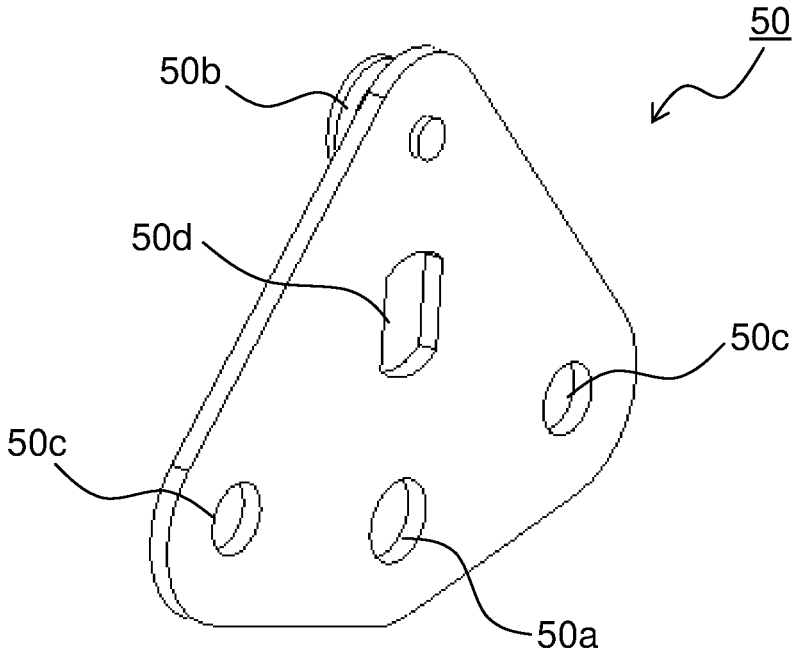
FIG. 21 is a perspective view of a gear pitch retention member 50 as seen from a front surface side thereof.
Figure 22:
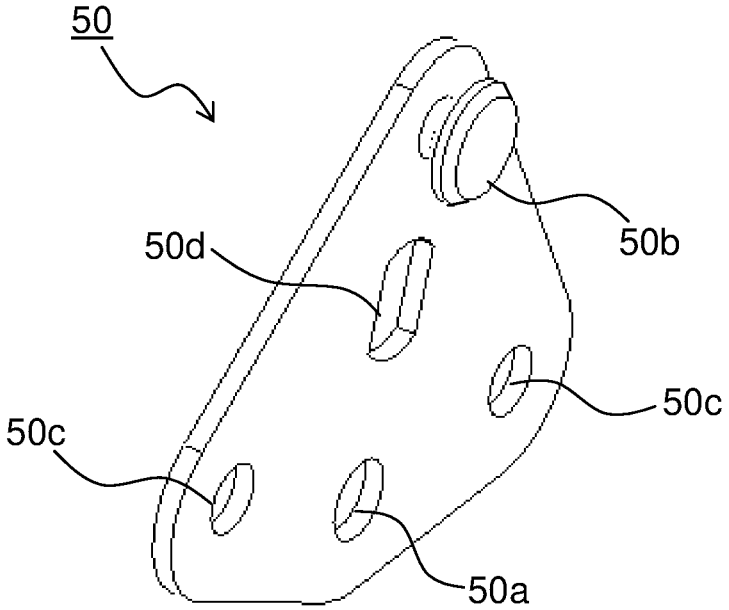
FIG. 22 is a perspective view of the gear pitch retention member 50 as seen from a back surface side thereof.

FIG. 20 is a longitudinal sectional view (a sectional view as seen from a direction indicated by arrows B and B' in FIG. 19) including an engagement part between the rack 32 and the rack driving gear 47. FIG. 21 is a perspective view of the gear pitch retention member 50 as seen from a front surface side thereof, and FIG. 22 is a perspective view of the gear pitch retention member 50 as seen from a back surface side thereof. The gear pitch retention member 50 includes a first engagement portion 50*a*, a second engagement portion 50*b*, a screw insertion hole 50*c*, and a rotation restriction hole 50*d*.

The first engagement portion 50*a* is formed as a round hole piercing through the gear pitch retention member 50 in a front-back direction thereof and engages with a rotation shaft 47*a* of the rack driving gear 47. The first engagement portion 50*a* is formed to have an inner diameter slightly larger than an outer diameter of the rotation shaft 47*a* so that the rotation shaft 47*a* is rotatable in a state of engaging with the first engagement portion 50*a*.

The second engagement portion 50*b* is formed as a boss protruding to a back surface side of the gear pitch retention member 50 and comes into contact with an upper surface of the flange portion 32*a* of the rack 32. The second engagement portion 50*b* is formed in a circular shape so as to reduce a sliding load between itself and the flange portion 32*a* during reciprocation of the wiper carriage 33 (the rack 32). At an end of the flange portion 32*a* in a protruding direction thereof (a left direction in FIG. 20), an upwardly protruding rib 32*b* that is triangular in section is formed to extend over an entire region in a longitudinal direction of the flange portion 32*a*. The rib 32*b* prevents the second engagement portion 50*b* from falling off from the upper surface of the flange portion 32*a*.

The screw insertion hole 50*c* is formed at each of two locations on both sides on the first engagement portion 50*a*, and the screw 80 (see FIG. 19) for fixing the gear pitch retention member 50 to the supporting frame 40 is inserted thereinto. The rotation restriction hole 50*d* is an elongated hole formed at substantially a center of the gear pitch retention member 50 and engages with a rotation restriction boss (not shown) provided on a unit frame 81 (see FIG. 19) disposed outside the supporting frame 40. This restricts rotation of the gear pitch retention member 50 caused by reciprocation of the rack 32.

According to the above-described configuration, a positional relationship (a spacing) in the up-down direction between the rack 32 and the rack driving gear 47 during reciprocation of the wiper carriage 33 is maintained constant by the first engagement portion 50*a* and the second engagement portion 50*b* of the gear pitch retention member 50.

Figure 23:
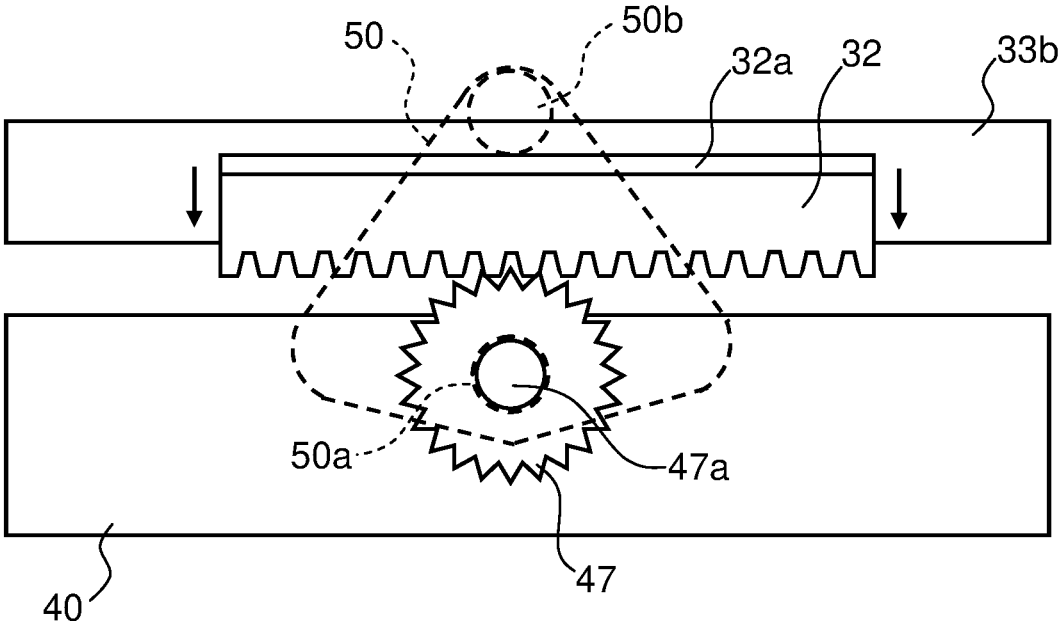
FIG. 23 is a schematic view showing a positional relationship between the rack 32 and the wiper carriage 33 in a case where a spacing between the wiper carriage 33 and the rack driving gear 47 is wide.

For example, in a case where a spacing between the wiper carriage 33 and the rack driving gear 47 has become wider due to, for example, warping of the supporting frame 40 or dimensional tolerance of a clearance of an outer diameter or an inner diameter of the sliding pulley 36, as shown in FIG. 23, the rack 32 moves downward within a range of play (backlash) with respect to the wiper carriage 33.

Figure 24:
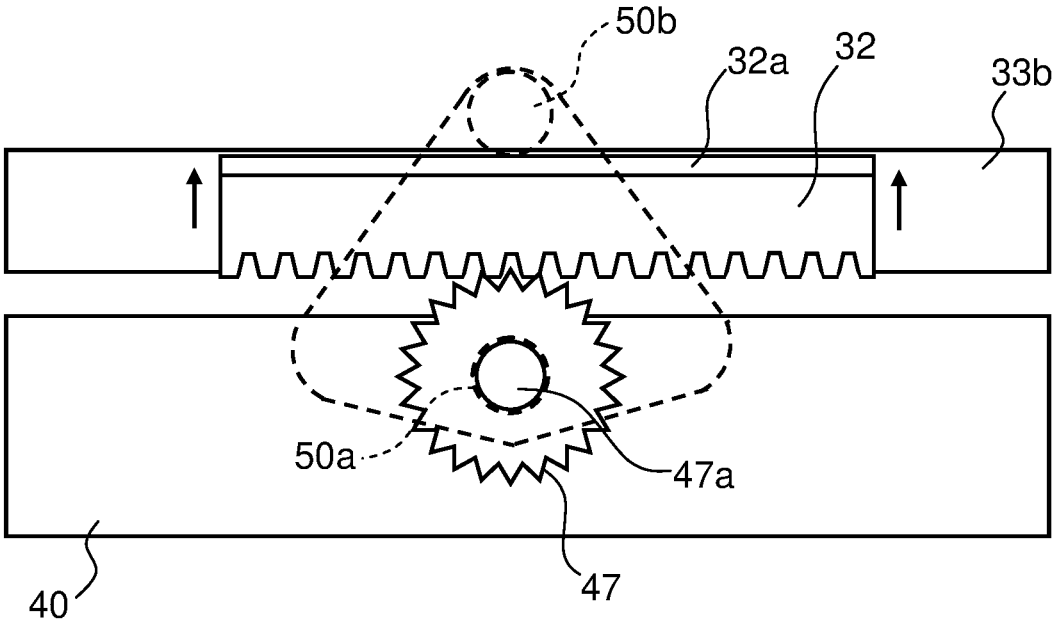
FIG. 24 is a schematic view showing a positional relationship between the rack 32 and the wiper carriage 33 in a case where a spacing between the wiper carriage 33 and the rack driving gear 47 is narrow.

Furthermore, in a case where the spacing between the wiper carriage 33 and the rack driving gear 47 has become narrower, as shown in FIG. 24, the rack 32 moves upward within the range of play (backlash) with respect to the wiper carriage 33. In either of the cases shown in FIG. 23 and FIG. 24, an amount of meshing (a gear pitch) between the rack 32 and the rack driving gear 47 is maintained constant by the gear pitch retention member 50.

Thus, irrespective of warping of the supporting frame 40, dimensional tolerance of a clearance of an outer diameter or an inner diameter of the sliding pulley 36, an error in attaching the rack 32, or the like, an amount of meshing (a gear pitch) between the rack 32 and the rack driving gear 47 can always be maintained constant. Accordingly, it is possible to prevent a decrease in efficiency in transmitting a driving force from the rack driving gear 47 to the rack 32 and occurrence of tooth skipping, which result from a decrease in the amount of meshing (shallower messing), an increase in driving load, which results from an increase in the amount of meshing (deeper meshing), and fluctuations in speed of the wipers 35 caused thereby, thus suppressing a failure to wipe the ink ejection surfaces F.

Other than the above, the present invention is not limited to the foregoing embodiment and can be variously modified without departing from the spirit of the invention. For example, as the unit moving mechanism constituted of the driving motor 72, the gear train, and so on and the unit ascending/descending mechanism 77 constituted of the wipe ascending/descending motor 76, the gear train, the rotation shaft 75, the supporting arm 74, and so on, conventionally known other driving mechanisms can be used.

Furthermore, the number of the ejection nozzles 18 of each of the recording heads 17*a* to 17*c*, a nozzle spacing therebetween, or the like can be set suitably in accordance with specifications of the printer 100. Furthermore, the number of the recording heads is also not particularly limited. For example, in each of the line heads 11C, 11M, 11Y, and 11K, one, two, four or more recording heads 17 may be disposed.

The present invention is usable for a recording head maintenance device that causes a wiper for wiping an ink ejection surface of a recording head to move horizontally by use of a rack and a rack driving gear. Through the use of the present invention, there is provided a recording head maintenance device that is capable of, by use of a simple configuration, maintaining constant a distance between a rack provided on a carriage having a wiper fixed thereto and a rack driving gear that transmits a driving force to the rack.

The invention claimed is:

1. A recording head maintenance device, comprising:

a wiper that is used to wipe an ink ejection surface of a recording head that ejects ink on a recording medium;

a wiper carriage that has the wiper fixed thereto;

a supporting frame that supports the wiper carriage so that the wiper carriage is movable in a horizontal direction;

a wiper moving mechanism that causes the wiper carriage to reciprocate along the supporting frame; and a unit ascending/descending mechanism that causes the supporting frame to ascend/descend together with the wiper carriage in such a direction as to approach or separate from the ink ejection surface, the wiper carriage being caused to reciprocate and ascend/descend so as to perform wiping of the ink ejection surface, wherein the wiper moving mechanism includes:

a rack that is supported to the wiper carriage so as to be movable in an up-down direction;

a wiper driving motor that is provided in the supporting frame;

a rack driving gear that transmits a driving force of the wiper driving motor to the rack;

a sliding member that is rotatably supported to the wiper carriage and comes into contact with the supporting frame so as to retain constant a spacing between the wiper carriage and the supporting frame; and a gear pitch retention member that maintains constant a positional relationship in the up-down direction between the rack and the rack driving gear during reciprocation of the wiper carriage.

2. The recording head maintenance device according to claim 1, wherein the gear pitch retention member includes:

a first engagement portion that rotatably holds a rotation shaft of the rack driving gear; and a second engagement portion that slidably engages with the rack.

3. The recording head maintenance device according to claim 2, wherein the rack includes a flange portion that protrudes horizontally along a moving direction of the wiper carriage, and the second engagement portion is in a circular shape having an outer circumferential surface that comes into contact with an upper surface of the flange portion.

4. The recording head maintenance device according to claim 3, wherein at an end of the flange portion in a protruding direction thereof, an upwardly protruding rib is formed to extend over an entire region in a longitudinal direction of the flange portion.

5. The recording head maintenance device according to claim 1, wherein at a center of the gear pitch retention member, an elongated rotation restriction hole is formed that engages with a unit frame disposed outside the supporting frame.

6. The recording head maintenance device according to claim 1, wherein the wiper carriage includes a positioning member that, when the wiper carriage, together with the supporting frame, has approached the ink ejection surface, comes into contact with a head housing holding the recording head so as to retain constant a spacing between the wiper and the ink ejection surface.

7. The recording head maintenance device according to claim 1, wherein the wiper comprises a plurality of wipers, and the wiper carriage has the plurality of wipers fixed thereto, and the recording head comprises a plurality of recording heads, and the wiper carriage is caused to reciprocate and ascend/descend so that wiping of the ink ejection surface is performed simultaneously with respect to the plurality of recording heads.

8. An ink-jet recording apparatus, comprising:

a recording medium conveyance portion that conveys a recording medium;

a recording portion in which a recording head is provided that ejects ink on the recording medium being conveyed by the recording medium conveyance portion; and the recording head maintenance device according to claim 1 that performs wiping of the ink ejection surface of the recording head disposed in the recording portion.

* * * * *